US006022448A

United States Patent [19]

Eriksson et al.

[11] Patent Number: 6,022,448

[45] Date of Patent: Feb. 8, 2000

[54] COATED PAPERBOARD FOR FORMED ARTICLES

[75] Inventors: Göran Eriksson; Klas-Erik Karlsson; Nils Åke Larsson, all of Gävle; Sven Håkansson, Furuvik, all of Sweden

[73] Assignee: Korsnab AB, Gavle, Sweden

[21] Appl. No.: 08/913,110

[22] PCT Filed: Jan. 25, 1996

[86] PCT No.: PCT/SE96/00079

§ 371 Date: Oct. 10, 1997

§ 102(e) Date: Oct. 10, 1997

[87] PCT Pub. No.: WO96/28609

PCT Pub. Date: Sep. 19, 1996

[30] Foreign Application Priority Data

Mar. 16, 1995 [SE] Sweden ..... 9500949

[51] Int. Cl.[7] ..... D21G 1/00; D21H 19/00

[52] U.S. Cl. ..... 162/123; 162/135; 162/136; 162/137; 162/205; 162/206; 162/207; 427/361

[58] Field of Search ..... 162/123, 135, 162/136, 137, 204, 205, 206, 207, 361, 358.3; 427/209, 361, 391, 411; 428/357; 118/101, 100, 106, 122

[56] References Cited

U.S. PATENT DOCUMENTS

| | | | |
|---|---|---|---|
| 4,289,808 | 9/1981 | Huang | 427/209 |
| 4,391,833 | 7/1983 | Self et al. | 426/523 |
| 4,828,650 | 5/1989 | Wagle et al. . | |
| 5,137,678 | 8/1992 | Hess et al. . | |
| 5,328,510 | 7/1994 | Hofmann et al. | 118/101 |
| 5,378,497 | 1/1995 | Johnson et al. | 427/211 |

OTHER PUBLICATIONS

Baumeister. T., ed. Marks' Mechanical Engineers' Handbook, NY, McGraw–Hill, 1958. pp. 5–36.

Gratton, et al. "Temperature–Gradient Calendering of Foodboard", Tappi Journal, Jan. 1988, pp. 81–86.

Scott, et al., Properties of Paper: An Introduction, Tappi Press, 1995, pp. 144–147.

Nykopp, "Soft Calendering Makes Hard Progress on Raising Quality", Pulp & Paper, May. 1994, p. 36.

*Primary Examiner*—Jose Fortuna
*Attorney, Agent, or Firm*—Bacon & Thomas

[57] ABSTRACT

The present invention relates to coated paperboard for formed articles, which paperboard consists of a fibermatrix in one, two or more layers and a coating and has adequate surface for printing and adequate surface gloss for each specific type of formed articles. The paperboard has been calendered after coating with a heatable calender having a soft extended nip, and has reduced density and reduced grammage at a given value for bending force compared to corresponding coated paperboard which has been calendered before or during and after coating with a heatable or non-heatable calender having a hard or soft nip. Additionally, a production line for the production of such coated paperboard, a process for the production of such coated paperboard, and a method of reducing the susceptibility to crack formation at folding of such a coated paperboard, are described.

4 Claims, No Drawings

COATED PAPERBOARD FOR FORMED ARTICLES

This Appliction is a 371 of PCT/SE96/000 76, filed on Jan. 25, 1996.

The present invention relates to coated paperboard for formed articles, e.g. liquid packaging board or white top liner, a process for the production thereof, a production line, and a method of reducing the susceptibility to crack formation at folding of a coated paperboard.

BACKGROUND OF THE INVENTION

For resource saving and improved economics it is advantageous to reduce the amount of raw materials needed for the production of a specific type of product. In a mill annually producing 200 000 tons of paper board for liquid packaging, a reduction of the amount of raw materials needed for 1 litre packages by 1% would make it possible to pack for example 70 million litres of milk products more per year without increasing the amount of raw materials used.

In Sweden this corresponds to the yearly consumption of milk in a city of the size of Gothenburg.

However, savings of raw material should desirably be achieved without having to compromise with the quality requirements of the product.

Important properties of coated paperboard for formed articles are sufficient stiffness measured as bending force, good forming properties including low susceptibility to crack formation at folding, adequate surface for printing and adequate surface gloss. All of these required properties vary with the specific type of formed article which is to be produced from the coated paperboard.

A conventional way of producing board with high stiffness is to use a fibermatrix with three or more layers where the middle layer gives bulk and the two outer layers have a high elasticity modulus or high tensile stiffness. However, there are also coated board with high stiffness made from only two fiber layers.

In the production of coated paperboard it is known that the calendering operation together with the coating contributes to a good printing surface. However, at the same time the stiffness is to a certain extent reduced. In order to achieve an adequate surface for printing a calendering operation has been performed to reduce the surface roughness before the paperboard is subjected to a coating operation. Depending on the type of final product to be produced sometimes there is also performed a calendering operation after the coating operation to further improve the surface and increase the gloss to the desired level.

There are mainly two types of heatable or non-heatable calenders which are in use in paper mills today, namely hard nip calenders which have steel rolls, and soft nip calenders which have steel rolls where the counter rolls have a softer cover. The nip lengths in these soft nip calenders are typically approximately 1 cm.

A new type of calender is disclosed in Pulp & Paper International (PPI), May 1994, page 36. Surface properties of an uncoated board grade were reported to be improved with only minor loss of stiffness (bulk). The new calender is constructed to have a relatively soft elastic moving belt supported by a glide body or roll instead of the covered roll in a conventional soft calender. The elongated nip contour in combination with the soft elastic belt is reported to yield uniform specific pressures and nip lengths which typically would be four to six centimeter. This new type of calender has been named supersoft calender in said article, and said calender could be used in the present invention where a heatable calender with soft extended nip is required.

In the production of paperboard for formed articles the calendering operation has up to now been performed either before or both before and after the coating operation.

DESCRIPTION OF THE INVENTION

It was surprisingly found that by deleting the conventionally used calendering operation before the coating operation and by performing a calendering operation only after the coating operation with a calender which is run at high temperature and has a soft extended nip in the production of coated paperboard for formed articles, it was possible to obtain coated paperboard with reduced susceptibility to crack formation at folding and with adequate or improved surface for printing and adequate or improved surface gloss for specific types of formed articles and at the same time much increased stiffness. By reducing the thus obtained increased stiffness to values previously set for a certain type of product, it is now possible to significantly reduce the grammage and thus the amount of raw materials needed.

Savings in raw material can be made in the amount of fibermatrix used and/or the amount of coating used.

Thus, the present invention provides in one aspect a coated paperboard for formed articles, including liquid packaging board and white top liner, which paperboard consists of a fibermatrix in one, two or more layers and a coating and has adequate surface for printing and adequate surface gloss for each specific type of formed articles. The characteristic features of said paperboard are that it has been calendered after coating with a heatable calender having a soft extended nip, and has reduced density and reduced grammage at a given value for bending force compared to corresponding coated paperboard which has been calendered before or before and after coating with a heatable or non-heatable calender having a hard or soft nip.

The term "extended nip" is considered to comprise nip lengths of 3 to 10 cm, such as 4 to 8 cm, e.g. 6 to 7 cm.

The fibermatrix used in the present invention is preferably composed of sulphate pulp and/or mechanical pulp and/or recycled pulp, and is either unbleached or bleached. The coating of the board is composed of binders and usually also pigments to enhance the printability. Examples of common binders in this context are latex and starch, and examples of common pigments are clay and calcium arbonate.

The given value for bending force depends on the specific type of formed articles which are to be produced. Small formed articles or packages do not need as high values for bending force as larger ones. For example, for a coated liquid board from which smaller, such as 250 ml, packages are to be produced, values for bending force may be in the range of 50 to 100 mN, and for a coated liquid board from which larger, such as 1 liter, packages are to be produced values for bending force may be in the range of 200 to 300 mN.

Thus, in an embodiment of the invention there is provided coated paperboard for formed articles, wherein said given value for bending force is in the range of 20 to 300 mN, said reduction of density is in the range of 1–50% and said reduction of grammage is in the range of 1–20%.

In another embodiment of the invention there is provided coated paperboard for formed articles, wherein said given value for bending force is in the range of 60–270 mN, said reduction of density is in the range of 1 to 35% and said reduction in grammage is in the range of 1–15%.

The percent reduction of the density and the percent reduction of the grammage of the coated paperboard at a given value for bending force are calculated on a corresponding coated paperboard for the same specific type of formed articles which has been calendered before or before and after coating with a heatable or non-heatable calender having a hard or soft nip.

In a preferred embodiment the fibermatrix of the coated paperboard of the invention is composed of two layers.

In another preferred embodiment of the coated paperboard of the invention the fibermatrix is composed of unbleached sulphate pulp in the bottom layer and bleached sulphate pulp in the top layer and the coating comprises binders and pigments.

In another aspect of the invention there is provided a production line for the production of coated paperboard, which paperboard consists of a fibermatrix in one, two or more layers and a coating and has adequate surface for printing and adequate surface gloss for each specific type of formed articles. The characteristic feature of this new production line is that there is arranged, only after a coating device, a heatable calender with a soft extended nip.

Although a calendering operation with a heated calender having a soft extended nip is needed only after a coating operation for the production of coated paperboard for formed articles which paperboard consists of a fibermatrix in one, two or more layers and a coating and has adequate surface for printing and adequate surface gloss for each specific type of formed articles, the present invention also comprises production lines where there is additionally arranged a calender before the coating device. There may be special circumstances when such precalenering would be preferred, such as exceptionally high demands for surface properties. If a precalendering is performed then the savings of raw material will be less. The precalendering before the coating operation may be performed with any type of calender.

In yet another aspect of the invention there is provided a process for the production of coated paperboard for formed articles with adequate surface for printing and adequate surface gloss for each specific type of formed articles, wherein the fibermatrix of the paperboard is composed of one, two or more layers. The characteristic feature of the process is that a calendering operation is performed only after a coating operation with a calender which is run at high temperature and has a soft extended nip.

In principal, the higher the temperature is, the better the surface properties of the coated paperboard will be. Typically the calender temperatures is in the range of 140 to 250 ° C., but even higher temperatures are possible.

The present invention also comprises a process for the production of coated paperboard for formed articles wherein there is additionally performed a calendering operation before said coating operation.

In still another aspect of the invention there is provided a method of reducing the susceptibility to crack formation at folding of a coated paperboard with adequate surface for printing and adequate surface gloss for each specific type of formed articles, wherein the fibermatrix of the paperboard is composed of one, two or more layers. The characteristic feature of the method is that said coated paperboard is produced in a production line wherein a calendering operation is performed only after a coating operation with a calender which is run at high temperature and has a soft extended nip.

The present invention also comprises such a method, wherein there is additionally performed a calendering operation before said coating operation.

The following Examples will illustrate the different aspects of the invention.

In the examples a fibermatrix in two layers, a bottom layer of unbleached sulphate pulp and a top layer of bleached sulfate pulp, and a coating consisting of pigments and binders, were used.

The Print-surf roughness at 1000 kPa was measured according to ISO 87914:1992 (E).

The Gloss was measured according to Tappi, T 480.

The Density was measured according to SCAN P 7:75.

The Bending force was measured according to SCAN P 29:84.

The Uniformity variance was evaluated with the aid of an image analyzer "Kontron IBAS" system.

The grammage was measured in accordance with SCAN P6:75.

EXAMPLE 1

In a pilot trial it was shown that the uniformity of the coated surface was better when the calendering after coating was done with an extended soft nip in comparison with a conventional soft nip. The board was in this case calendered also before coating.

It was also shown that the density was lower when using an soft extended nip in comparison with a conventional soft calender.

| | Print-surf roughness $\mu$m | Gloss | Density, kg/m$^3$ | Uniformity variance, % |
|---|---|---|---|---|
| Soft | 3.23 | 38 | 685 | 0.74 |
| nip | 2.73 | 45 | 730 | 0.77 |
| 140° C. | 2.43 | 51 | 749 | 0.80 |
| Extended | 3.24 | 32 | 661 | 0.63 |
| soft | 3.06 | 39 | 680 | 0.62 |
| nip | 2.46 | 43 | 687 | 0.63 |
| 140° C. | | | | |

The uniformity of the coating was measured in an image analyzer in the wave length area 2.0–8.0 mm.

EXAMPLE 2

In another pilot trial it was shown that taking advantage of the decreased density, the stiffness could be increased by using the soft extended nip calender after coating. The effect was greatest when no calendering was done before coating and the coat weight was reduced.

| | Print-surf roughness $\mu$m | Gloss | Grammage g/m$^2$ | Bending force mN | Density kg/m$^3$ |
|---|---|---|---|---|---|
| Cbc + 21 g/m$^2$ coating | 3.75 | 29 | 266 | 255 | 675 |
| No Cbc + 21 g/m$^2$ coating + Cac with SEN | 3.75 | 31 | 266 | 266 | 650 |

-continued

| | Print-surf roughness μm | Gloss | Grammage g/m² | Bending force mN | Density kg/m³ |
|---|---|---|---|---|---|
| Cbc + 11 g/m² coating + Cac with SEN | 3.75 | 27 | 266 | 267 | 660 |
| No Cbc + 11 g/m² coating + Cac with SEN | 3.75 | 32 | 266 | 280 | 639 |

Cbc = Calendering before coating
Cac = Calendering after coating
SEN = Soft Extended Nip

EXAMPLE 3

In a mill trial the soft extended nip calender was used to produce the same surface as the reference quality which was calendered only before coating. When the extended nip calender was used the calendering was done only after coating.

| | Grammage g/m² | Gloss | Bending force, mN | Print-surf roughness μm | Density kg/m³ |
|---|---|---|---|---|---|
| Cbc + 22 g/m² coating | 255 | 17 | 228 | 3.9 | 651 |
| No Cbc + 11 g/m² coating + Cac with SEN | 255 | 25 | 266 | 3.3 | 597 |

Cbc = Calendering before coating
Cac = Calendering after coating
SEN = Soft Extended Nip The stiffness increase measured as bending force was greater than in the pilot trials.

This increase in stiffness means that the grammage can be reduced from 255 g/m² to 245 g/m² keeping the other specifications at the same or even improved levels. This improvement makes it possible to further decrease the grammage.

Board from the mill trial was also tested against the susceptibility to crack formation at folding of a coated paper board.

The tendency of crack formation was measured by folding the board in a controlled manner according to a standardized method developed for this purpose and evaluating the crack tendency on a scale of 1 to 5 as follows:

0 = Perfect
1 = Good
2 = Tendency to crack
3 = Small crack
4 = Crack
5 = Big crack -continued

| | Susceptibility to crack formation | |
|---|---|---|
| | top side | bottom side |
| Cbc + 22 g/m² coating | 3.2 | 3.0 |
| No Cbc + 11 g/m² coating + Cac with SEN | 1.4 | 1.3 |

The board from the mill trial was also printed and the print result was evaluated. The overall print result and the uniformity of the print was better for the test quality.

| | Uniformity Variance % | (image analyzer 0.35–5.6 mm) |
|---|---|---|
| Cbc + 22 g/m² coating | 9.54 | |
| No Cbc + 11 g/m² coating + Cac with SEN | 5.15 | |

Cbc = Calendering before coating
Cac = Calendering after coating
SEN = Soft Extended Nip

We claim:

1. In a process for the production of coated paperboard for formed articles with adequate surface for printing and adequate surface gloss for each specific type of formed articles, and wherein the fibermatrix of the paperboard is composed of one, two or more layers, wherein the improvement comprises performing the calendering operation only after the coating operation with a calender which is run at high temperature and has a soft extended nip to produce a paperboard comprising a fibermatrix in one, two or more layers and a coating for printing having reduced susceptibility for crack formation at folding, which paperboard has been calendered after coating with a heatable calender having a soft extended nip, to impart to said coated paperboard a reduced density and reduced grammage at the same bending moment compared to a corresponding coated paperboard of the same number of layers and using the same raw materials, which has been calendered before or before and after coating with a heatable or non-heatable calender having a hard or soft nip.

2. Process for the production of coated paperboard according to claim 1, wherein there is additionally performed a calendering operation before said coating operation.

3. In a method of reducing the susceptibility to crack formation and folding of a coated paperboard with adequate surface for printing and adequate surface gloss for each specific type of article, wherein the fibermatrix of the paperboard comprises one, two or more layers, wherein the improvement comprises producing the paperboard in a production line wherein a calendering operation is performed only after a coating operation with a calender which is run at high temperature and has a soft extended nip to produce a paperboard comprising a fibermatrix in one, two or more layers and a coating for printing having reduced susceptibility for crack formation at folding, which paperboard has been calendered after coating with a heatable calender having a soft extended nip, to impart to said coated paperboard a reduced density and reduced grammage at the same bending moment compared to a corresponding coated paperboard of the same number of layers and using the same raw materials, which has been calendered before or before and after coating with a heatable or non-heatable calender having a hard or soft nip.

4. Method of reducing the susceptibility to crack formation at folding of a coated paperboard according to claim 3, wherein there is additionally performed a calendering operation before said coating operation.

* * * * *